United States Patent [19]

Eyman

[11] Patent Number: 4,516,499

[45] Date of Patent: May 14, 1985

[54] QUICK ACCESS SPLICE FOR MISSILE SECTIONS

[75] Inventor: Ralph A. Eyman, Clermont, Fla.

[73] Assignee: The United States of America as represented by the Secretary of the Army, Washington, D.C.

[21] Appl. No.: 509,577

[22] Filed: Jun. 30, 1983

[51] Int. Cl.[3] ..... F42B 13/00

[52] U.S. Cl. ..... 102/293; 102/377

[58] Field of Search ..... 102/293, 377; 285/33, 285/81, 399, 403; 403/315-319

[56] References Cited

U.S. PATENT DOCUMENTS

| | | | |
|---|---|---|---|
| 2,779,283 | 1/1957 | Baughman | 102/377 |
| 4,348,956 | 9/1982 | Schmidlin | 102/377 |

FOREIGN PATENT DOCUMENTS

| | | | |
|---|---|---|---|
| 2231549 | 2/1979 | Fed. Rep. of Germany | 102/377 |
| 2844239 | 4/1980 | Fed. Rep. of Germany | 102/377 |
| 2038918 | 7/1980 | United Kingdom | 102/377 |

*Primary Examiner*—Charles T. Jordan

*Attorney, Agent, or Firm*—Anthony T. Lane; Robert P. Gibson; James T. Deaton

[57] ABSTRACT

A device for securing two missile sections together and allowing for quick access splice and separation of the missile sections.

5 Claims, 5 Drawing Figures

QUICK ACCESS SPLICE FOR MISSILE SECTIONS

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

In the past, various means have been providing for securing missile sections together. However these means have not provided as desirable a splice as is needed for a splice that can be easily connected and disconnected with a close tolerance fit between the missile sections. Therefore, there is a need for a splice connection between missile sections that enables the sections to be secured together and also to be separated quickly from each other.

Therefore, it is an object of this invention to provide a splice between missile sections that has quick access for connecting the missile sections together and also for allowing quick separation thereof.

Another object of this invention is to provide a quick access missile splice which includes means that can be latched to allow the missile sections to be telescoped together and as they are being telescoped together to be released to secure the sections together.

Other objects and advantages of this invention will be obvious to those skilled in this art.

SUMMARY OF THE INVENTION

In accordance with this invention, a quick access missile splice is provided which includes telescoping missile sections with mating surfaces and guide means for mating the sections together and shear pin type latch means that unlatches in the telescoped position to hold the missile sections together. Also, the latch means is such that it can be reset into a latching position to allow the missile sections to be separated from each other as desired.

DESCRIPTION OF THE PREFERRED EMBODIMENT

Figure 1:
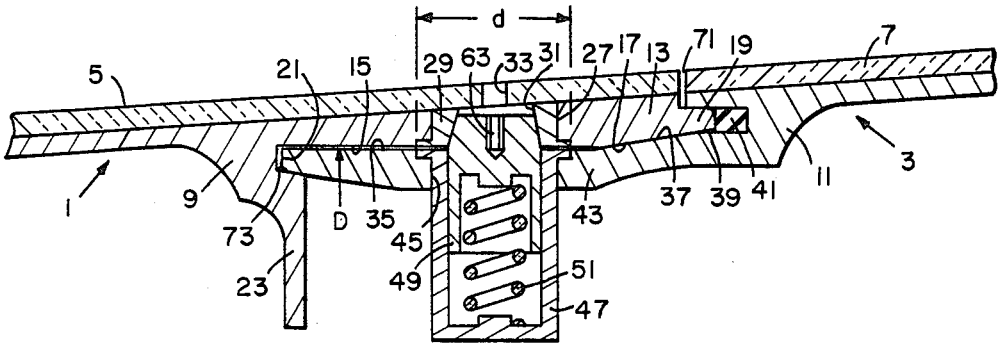
FIG. 1 is a sectional view of a quick access missile splice in accordance with this invention and illustrating missile sections telescoped together in a secured position.
Figure 2:
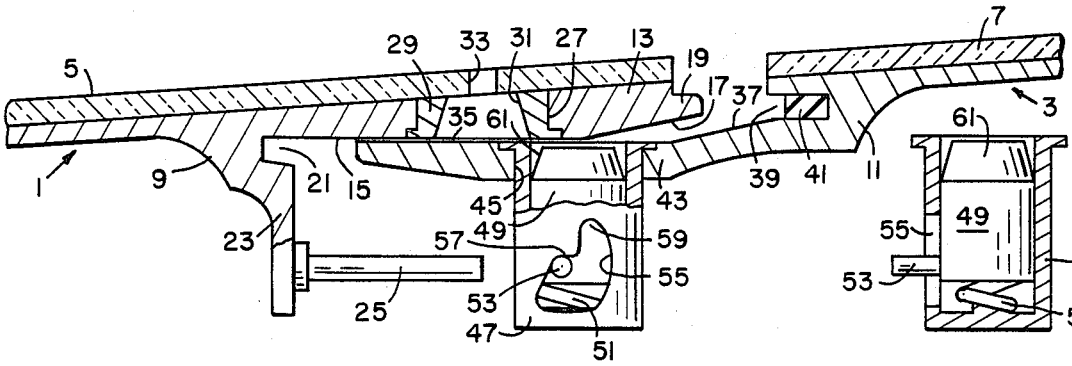
FIG. 2 is a sectional view and with portions cutaway of a quick access missile splice in accordance with this invention and illustrating the missile sections and latching means as they are being moved together for securing the missile sections together.
Figure 4:
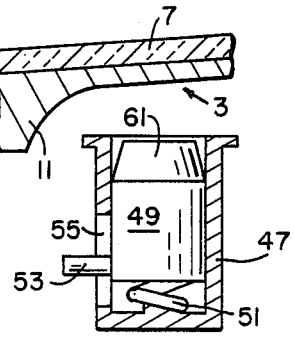
FIG. 4 is a sectional view illustrating details of the latch device.
Figure 3:
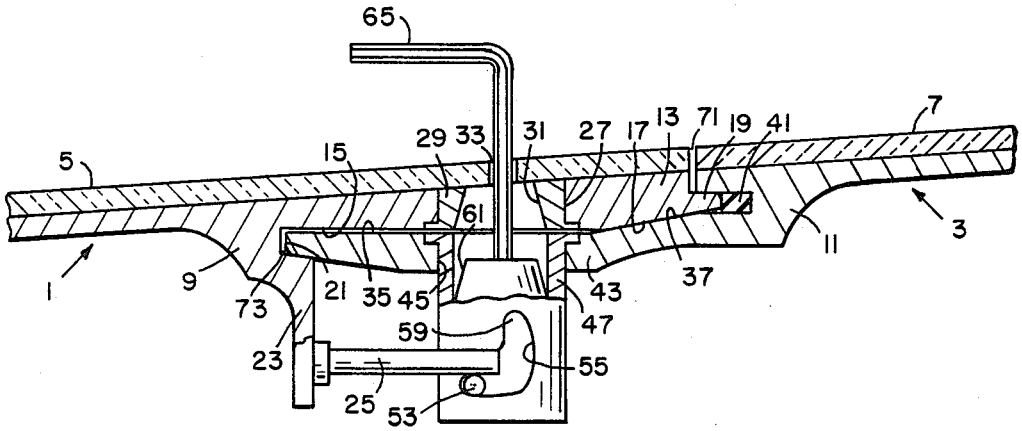
FIG. 3 is a sectional view and partially cutaway and illustrating resetting of the latch means to allow the missile sections to be separated.

Referring now to the drawings, FIGS. 1, 2 and 3 show longitudinal cross sections through the spliced joint during various stages of splicing operations of two conical missile sections 1 and 3. The two conical missile sections 1 and 3 form forward and aft sections that have outer surfaces that are generally covered with ablative heat shield type materials 5 and 7 of conventional structure. Forward and aft missile sections 1 and 3 have aluminum structural splice rings 9 and 11 that are designed to be telescoped together. Forward splice ring 9 includes a longitudinal structure 13 that has an internal cylindrical surface 15 with a tapered surface 17 at one end and formed with one end of structure 13 is a cylindrical tongue 19. At the other end of cylindrical surface 15, a groove 21 is formed in the ring and a ledge or leg 23 that projects inwardly of the ring supports a cylindrical trigger member 25 (see FIG. 2) that is conventionally mounted relative to support leg 23. Member 13 also has a stepped bore 27 therethrough with a hardened metal insert 29 mounted therein. Hardened metal insert 29 can be made of material such as hardened steel and metal insert 29 has a tapered, conical opening 31 therethrough. Also aligned with opening 31 is an opening 33 through ablative material 5.

Figure 5:
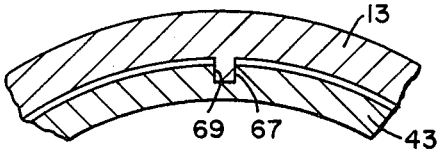
FIG. 5 is a sectional view illustrating a guide pin arrangement for the missile sections in accordance with this invention.

Aft missile section 3 with its ring section 11 includes an external cylindrical surface 35 for telescoping with cylindrical surface 15 and a tapered surface 37 of the same taper as tapered surface 17. A groove 39 in ring member 11 is designed to accept tongue 19 therein and a resiliant elastomer type seal 41 is mounted in a portion of groove 39 for sealing against tongue 19 to seal between the missile sections when they are brought together. Also, aft ring 11 with body section 43 has a stepped bore 45 through body section 43 with a hardened metal cylinder 47 mounted in the stepped bore as an insert. Cylinder 47 is also made of hard metal such as hardened steel. Each of inserts 47 and 29 are tightly fitted into stepped bores 45 and 27 to form permanent assemblies. A shear type pin 49 is rotatably and slidably mounted in cylindrical insert 47 and is spring biased outwardly by spring 51. Spring 51 also exerts a bias on pin 49 in the direction to the left as viewed in the figures to cause latch pin 53 mounted thereto to be rotatably biased to the left. Cylinder 47 has a cutout slot 55 (see FIG. 2) in the side wall thereof though which latch pin 53 projects. A latching ledge 57 is designed to retain latch pin 53 and shear pin 49 in a retracted position. When released from the retracted position, latch pin 53 is moved into forward section 59 when shear pin 49 is in the position illustrated in FIG. 1. Shear pin 49 has a conically tapered end 61 with a taper which is the same as tapered surface 31 of insert 29. The end of pin 49 has an opening 63 shaped for receiving an Allen wrench therein and for turning pin 49 with an Allen wrench 65 as illustrated in FIG. 3. Alignment pin means such as illustrated in FIG. 5 includes a pin 67 integral with member 13 and with a groove 69 in member 43 for providing alignment means for the forward and aft ring sections relative to each other. The forward and aft ring sections include a multiplicity of 3 or more of the splice joints as illustrated in FIGS. 1 and 2 for holding the missile sections together and with the splice joints being equally spaced about the circumference of the splice rings. It is also noted that a radial clearance is provided between cylindrical surfaces 15 and 35 of diameter D (see FIG. 1) which includes manufacturing tolerances plus a minimum, h, where $$h=\tfrac{1}{2}(D-\sqrt{D^2-d^2}),$$

to allow the surfaces of inserts 29 and 47 which have a diameter, d, to function as shear planes across pins 49. The clearance, h, is approximately 0.010 in. for a pin in pure shear. Also, the splice is purposely provided with external gap or space 71 (see FIG. 1), and an internal gap 73 between the ring structures such that fore and aft loads are always transmitted through shear pins 49.

During operation or mating of the missile sections together, forward and aft sections 1 and 3 are positioned relative to each other as illustrated in FIG. 2 and with pin 67 aligned with groove 69. When in this relationship, the forward and aft sections are moved together relative to each other and each of trigger members 25 are brought into contact with its respective latch pin 53 which dislodges latch pin 53 from ledge 57 to allow spring 51 to bias its respective pin 49 radially outward and into its respective insert 29 with taper 31. Also, as the sections are moved together, tongue 19 is moved into sealing relationship with seal 41 and the end of structure 43 is moved into groove 21 with tolerance gaps being left at 73 and 71. Pin 49 with tapered end surface 61 is biased by spring 51 into engagement with its respective tapered surface 31 and reverse loading of members 1 and 3 relative to each other causes mating tapered surfaces 31 and 61 to mate together. The spacing left at 71 and 73 allows pins 49 with their tapered surfaces to act in shear with their respective tapered mating surfaces 31. Tongue 19 and the end of member 43 in groove 21 resist upsetting moments caused by couples of lines of force lying off the shear surfaces and by deflections of materials under load. It is also pointed out that true position between the centers of all inserts 29 and pins 49 in combination with the force provided by springs 51 assures full engagement of the tapers 61 and 31 when sufficient reverse loading is applied to cause relative motion between the sections. After all pins 49 are seated, further motion is limited to the clearance provided between the cylindrical portion of each pin 49 and cylindrical insert 47 that it is mounted in. This clearance can be held to less than 0.001 inches by grinding and/or honing of these parts.

If it is desired to uncouple the forward and aft sections, Allen type wrench 65 is inserted through opening 33 and into socket 63 of pin 49 as illustrated in FIG. 3. Exerting inward force against spring 51 causes disengagement of the shear pin from taper 31 of insert 29. Torque, in combination with the inward force may be required to initially break the mating tapered surfaces apart. A clockwise rotation of the Allen wrench after shear pin 49 is pushed to the bottom of its respective cylindrical insert 47 captures latch pin 53 beneath trigger member 25 as illustrated in FIG. 3. After each of pins 49 are placed in this position, sections 1 and 3 can be separated. Separation retracts trigger members 25 allowing each latch pin 53 to snap back onto its ledge 57 of recess 55 and be retained in this position. Therefore, it can be clearly seen that an effective quick access splice pin connection is provided with such a structure as illustrated by applicant and also a structure that lends itself to separation.

I claim:

1. Forward and aft mating missile sections having a quick access splice, comprising cylindrical telescoping ring structures on the forward and aft sections, said forward section having a conically tapered cutout surface in said cylindrical ring structure and a trigger member mounted thereon, said aft structure having a pin with a conically tapered front surface and being held in a retracted position by latch means and a spring means biasing said pin radially outwardly for engagement of said front tapered surface on said pin with the conically tapered surface on said forward member, said trigger member being positioned relative to said latch means for said pin such that said trigger member releases said latch means as said forward and aft members are telescoped together to allow said spring means to bias said pin into engagement with said conically tapered surface of said forward member and provide a shear surface connecting means between said forward and aft structures for securing these members together.

2. Forward and aft missile sections as set forth in claim 1, wherein said forward and aft missile sections have an ablative material mounted on outer surfaces thereof, and said forward section has an opening through said ablative material and in alignment with said conically tapered cutout surface, said pin member has a tool opening therein and said latch means is positioned and of such a structure that a tool can be inserted into said pin member to retract said pin member and engage said latch means with said trigger member to hold said pin member in a retracted position to allow said forward and aft missile sections to be separated and disengaged.

3. Forward and aft missile sections as set forth in claim 1, wherein said cylindrical telescoping ring structures each have a groove at a base of its telescoping surface and a tongue portion at a forward end of each structure, and said groove of said aft ring having seal means mounted therein for sealing with the tongue portion of said forward ring structure.

4. Forward and aft missile sections as set forth in claim 3, wherein said conically tapered cutout surface is on a hardened insert that is mounted in said forward telescoping ring structure, and said pin is mounted in a hardened metal cylinder that is mounted in said aft cylindrical telescoping ring structure.

5. Forward and aft missile sections as set forth in claim 4, wherein said cylindrical telescoping ring structures have alignment pin means therein to cause said structures to have to be aligned before telescoping together.

* * * * *